United States Patent [19]

Herndl et al.

[11] Patent Number: 4,941,342

[45] Date of Patent: Jul. 17, 1990

[54] MULTI-RAM FORGING ASSEMBLY

[75] Inventors: Otto Herndl, Leverkusen; Werner Schiller, Bergisch-Gladbach, both of Fed. Rep. of Germany

[73] Assignee: Eumuco Aktiengesellschaft fur Maschinenbau, Fed. Rep. of Germany

[21] Appl. No.: 304,276

[22] Filed: Jan. 31, 1989

[30] Foreign Application Priority Data

Feb. 6, 1988 [DE] Fed. Rep. of Germany ..... 3803632

[51] Int. Cl.[5] ..... B21J 9/12

[52] U.S. Cl. ..... 72/402; 72/453.02; 72/453.18; 91/49

[58] Field of Search ..... 72/402, 453.01, 453.02, 72/453.06, 453.07, 453.08, 453.18; 100/269 R, 269 B; 91/49

[56] References Cited

U.S. PATENT DOCUMENTS

| | | | |
|---|---|---|---|
| 3,456,297 | 7/1969 | Andreasson | 100/269 R |
| 3,916,667 | 11/1975 | Paknke et al. | 72/402 |
| 3,948,148 | 4/1976 | Bringer | 91/49 |

FOREIGN PATENT DOCUMENTS

| | | | |
|---|---|---|---|
| 95782 | 12/1983 | European Pat. Off. | 91/49 |
| 1137617 | 10/1962 | Fed. Rep. of Germany | 72/453.18 |
| 1175534 | 8/1964 | Fed. Rep. of Germany | 72/453.18 |
| 1285506 | 1/1962 | France | 91/49 |
| 67490 | 6/1929 | Sweden | 91/49 |

*Primary Examiner*—Daniel C. Crane

*Attorney, Agent, or Firm*—Neil F. Markva

[57] ABSTRACT

A multi-ram forging assembly has a piston-cylinder unit for driving each ram carrying a forging tool wherein at least two diametrically opposed forging unit simultaneously act on a workpiece. Each piston-cylinder unit comprises a pressurized inlet chamber for containing a hydraulic pressure fluid at a predetermined pressure behind a piston movably disposed in the cylinder. The piston includes a front-end ram carrying a forging tool. A valve including a valve seat member is disposed on the piston at a rear side opposite to the front-end ram. A valve cone cooperates with the valve seat member to provide a closed position and an open position for the valve. An actuator is connected to move the valve cone between the closed and open positions. The piston includes a passage bore extending from the valve seat member to a pressure fluid discharge chamber connected to a hydraulic pressure fluid reservoir container providing a pressureless discharge of the pressure fluid medium. A piston return pressure chamber is located within the cylinder to cause the return of the piston under the action of a pressure fluid having a preselected predetermined pressure maintained within the piston return pressure chamber.

11 Claims, 2 Drawing Sheets

MULTI-RAM FORGING ASSEMBLY

FIELD OF THE INVENTION

This invention relates to a multi-ram forging assembly including interchangeable forging tools. More particularly, the invention relates to a multi-ram forging assembly where at least a pair of diametrically opposed forging tools simultaneously act on a forging workpiece and a piston-cylinder unit drives the rams.

BACKGROUND OF THE INVENTION

Various embodiments of forging assemblies are known for forging long axially symmetric workpieces such as by stretching and round kneading. In such forging assemblies, a hydraulic driving system is generally used requiring switch elements arranged in the usual manner remote from the piston-cylinder units. The hydraulic switch elements are operated electromagnetically. Due to the electromagnetic excitation with each switching operation and the switching element arrangement at a point remote from the piston-cylinder unit, the resultant times of switching and pressure build-up for each movement restrict the achievable stroke frequencies of such known forging assemblies to a low level. Moreover, with the prior art forging assemblies, the circuit system and total machine is very complex and expensive to produce and operate.

In known hydraulic driving systems, the working stroke and respective end positions of the piston are usually defined by solid, mechanical end stops or, optionally, by path-dependent controls. Such a design generally implies the disadvantage that the required accurate setting or control of the working piston stroke not only concerning its final positions, but also concerning its speed, is not possible by hydraulic means.

In a multi-ram forging assembly, the plurality of working cylinders are expected to operate absolutely synchronously and with identical stroke lengths. Coupling the working cylinders at the driven side to accomplish this purpose is a significant problem. Known working cylinder designs coupled to accomplish such synchronous movements cannot be adjusted and cannot be controlled to obtain identical stroke lengths for each of the total number of working cylinders. If the stroke is performed, it may not be influenced with the required regulating accuracy and the extent of movement and synchronism.

This problem is magnified with large volume working cylinders. Until now, it has not been possible to interconnect a plurality of large diameter working cylinders with closed position and/or speed control systems so that a synchronism may be achieved with respect to the several control systems required to operate a multi-ram forging assembly in such a case.

PURPOSE OF THE INVENTION

The primary object of the invention is to provide a multi-ram forging assembly having a hydraulic driving means and being uncomplicated in design with its function being simple and its performance being reliable.

Another object of the invention is to provide a multi-ram forging assembly having a clear increase of stroke frequency obtainable for the required large piston-cylinder units and, in particular, achieving adjustment and regulation through control of and influence on the working stroke of the cylinder-piston.

A further object of the invention is to perform the control of the working cylinder of each piston-cylinder unit to insure a plurality of such working cylinders may be operated together by simple means and under synchronous speed and stroke conditions without a complicated control system.

A still further object of the invention is to provide control of pressure fluid required for ram movement in a multi-ram forging assembly directly in each respective piston-cylinder unit with the pressure fluid required for initiating the movement of the working piston while eliminating the need for electromagnetic control of the respective valves.

Another object of the invention is to provide a cylinder-piston unit useful for driving a forging ram and having a design incorporating a simple control means for controlling the flow of hydraulic fluid medium to effect preselected limits on piston movement within the working cylinder.

SUMMARY OF THE INVENTION

The invention is directed to a control system for a multi-ram forging assembly wherein an actuator such as a servo unit controls a rod carrying a valve cone for opening and closing a valve seat located on the side of a piston opposite to the forging tool carried by the piston ram. Behind the valve seat, a throughflow bore in the piston extends from the valve seat to a pressure fluid discharge means in the cylinder. A pressurized inlet chamber ahead of the valve seat and piston is exposed to the action of the hydraulic pressure medium from the hydraulic system driving unit. A discharge conduit ensures the pressureless connection between a discharge chamber of said pressure fluid discharge means and the pressure fluid reservoir container of the hydraulic drive system. A central piston return pressure chamber having a smaller pressure surface than the inlet chamber is used to effect the return of the piston under the action of a pressure medium having a selected predetermined pressure maintained within the piston return pressure chamber.

The design of the piston-cylinder unit of the invention having such a hydraulic driving system is extraordinarily simple. The stroke movement and stroke position of the working piston are directly ensured by one valve cone movement only. In other words, motion characteristics, i.e., path and speed of the working piston movement, are indirectly and directly dependent upon the actuator whereas no additional valves need be operated for control of the piston within the working cylinder. The resultant stroke frequency may be very high because practically no switching times occur and the pressure build-up times are dictated only by the output of the centrally mounted pressure generating pump of the hydraulic fluid system. By this simple control means, the operating efficiency of the equipment is improved.

Each piston-cylinder unit of the multi-ram forging assembly includes an electronically enabled actuator as a servo unit. The motion characteristics of diametrically opposed working pistons are synchronized by known distance measuring means of the working movement. Moreover, the movements of all four working piston-cylinder units may be so synchronized that simultaneous working movements and also alternating, synchronized working movements successively realized in pairs, are produced.

Due to the electronic control of the forging assembly, the actuators are controlled to bring about constant stroke lengths regardless of the depth of penetration of the forging tools. The working strokes are preselected in response to the particular forging demands such as when preforming or finish-machining work operations are performed. Furthermore, the stroke position is changeable. By this means, there may be achieved the reversal of the working ram in the front working position and the workpiece thickness and the intended forging dimension is controlled accordingly.

A particular feature of the invention is directed to a valve seat member being part of a sole valve means of the piston-cylinder unit and being fixed to the working piston with the valve cone of said valve means suitably cooperating directly with a valve seat in the valve seat member. An annular piston return pressure chamber having a smaller pressure surface than the pressurized inlet chamber enables the automatic retention and return movement of the working piston without a further externally disposed control system. The central annular piston return chamber should be under a constant predetermined pressure during the operation of the piston-cylinder unit.

According to another feature of the invention, the servo units are servo motors for effecting simultaneous stroke movement, constant stroke length and uniform and/or paired stroke position setting of all cylinder units. Such servo units may be enabled and programmed electronically.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
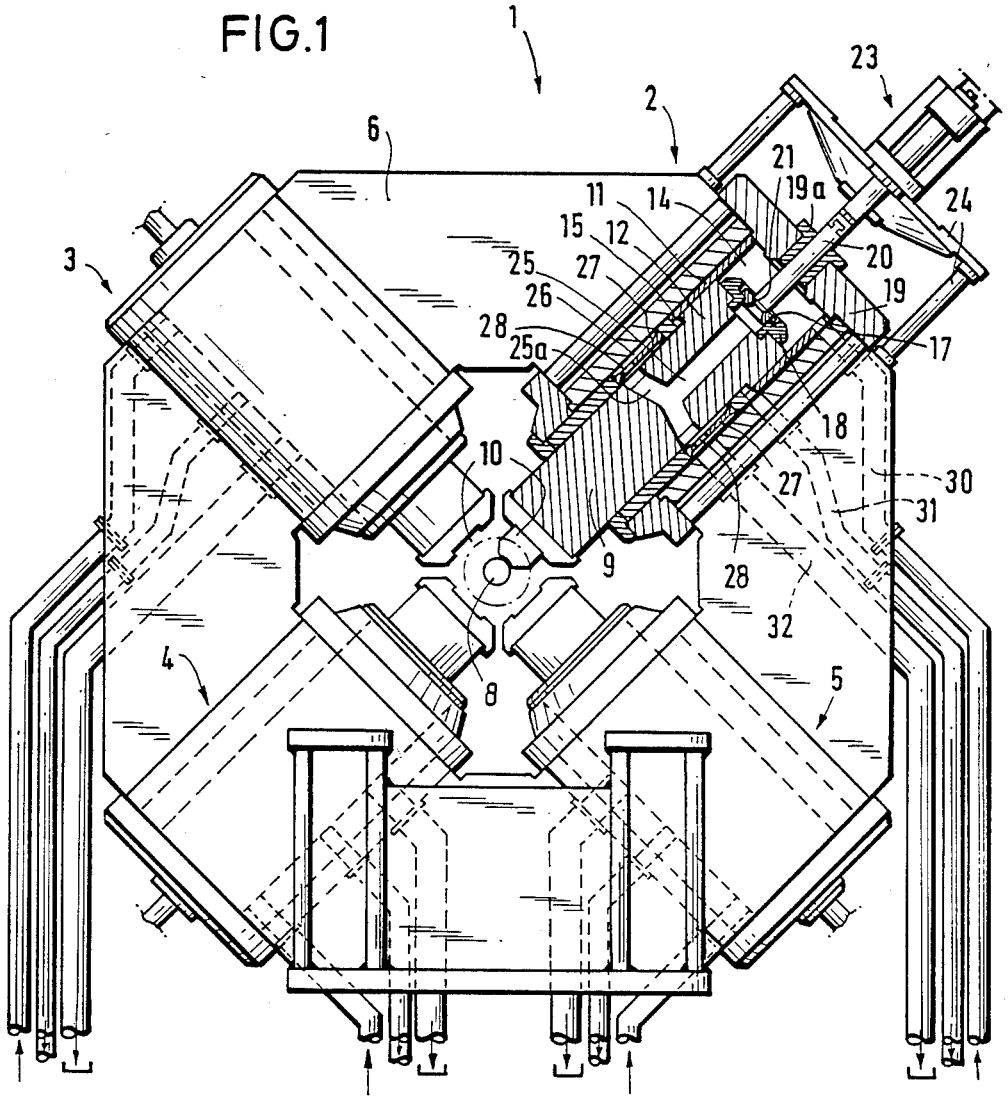
FIG. 1 is a schematic fragmentary elevational view partially in cross-section showing a forging assembly and piston-cylinder unit made in accordance with the invention.
Figure 2:
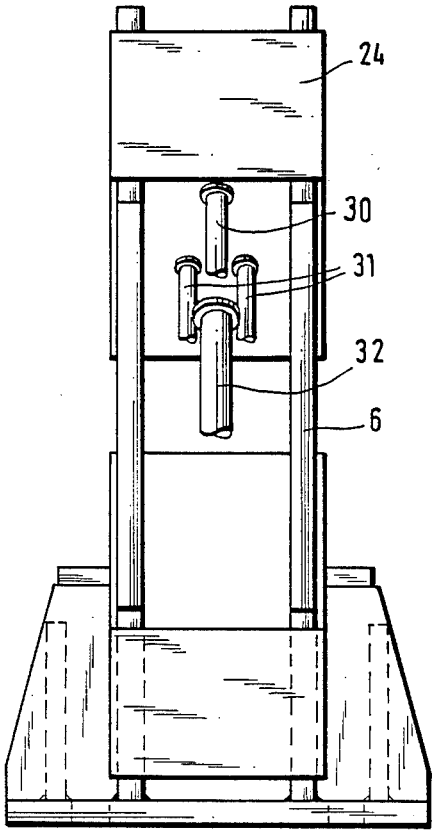
FIG. 2 is a side elevational view of the forging assembly of FIG. 1.

The forging assembly, generally designated 1, comprises four identical forging units, generally designated 2, 3, 4 and 5 disposed in frame 6. Since all the forging units 2–5 are of the same design, further explanations refer only to forging unit 2 as shown in cross-section. Deforming by the forging assembly is divided into two forms of processing, namely, stretching (major forging) and finishing (smoothing of the workpiece). For an average stretching process, a forging pressure of about 230 kp/cm$^2$ is required. For an average finishing process, a forging pressure of about 115 kp/cm$^2$ is needed.

Forging units 2, 3, 4 and 5 are radially disposed uniformly about workpiece 8 disposed in and along the forging axis. Two pairs of diametrically opposed forging units 2, 4 and 3, 5 each have a ram 9 fixed to its front end and an exchangeable forging tool 10 connected to a respective ram. Forging tool 10 may act simultaneously on workpiece 8, or always the two pairs of oppositely disposed rams of forging units 2, 4 or 3, 5 may act alternating on workpiece 8. That is, each opposed pair of rams in forging units 2, 4 and 3, 5 act simultaneously with respect to each other but alternating with respect to the other pair of forging units.

Forging unit 2 comprises a piston 12 slidingly disposed in a hydraulic cylinder 11. Piston 12 includes a front-end ram 9 carrying a forging tool 10. In this specific embodiment, piston 12 and ram 9 form a single one-piece unitary construction. A pressurized inlet chamber 14 is disposed at one end of hydraulic cylinder 11 behind piston 12 and contains hydraulic pressure fluid at a predetermined pressure. A piston return pressure chamber 15 located within cylinder 11 along the length of piston 12 is used to effect return movement of piston 12 after forward movement effects a forging blow to workpiece 8. The hydraulic pressure in chamber 14 upon effecting the forging blow corresponds to the forging force required for a given forging process with a maximum pressure during forging being from about 200 to about 600 kp/cm$^2$.

A valve seat member 17 fixed in a holding plate 18 is disposed on piston 12 confronting inlet chamber 14. The outer diameter of holding plate 18 is undercut. Cover 19 closes cylinder 11 forming one side of chamber 14 and including a guide bushing **19*a* for valve cone rod 20 which, at its front end, is designed to form a valve cone counterpart to valve seat 21 in valve seat member 17**.

Valve cone rod 20 is connected to an actuator, generally designated 23, which may be a linear drive adapted to initiate a preprogrammed stroke position and to perform the piston stroke movement of piston 12 in cylinder 11. Actuator 23 is mounted on trestle 24 disposed on machine frame 6. Actuator 23 axially displaces the valve cone rod 20 at a higher or lower speed thereby controlling the rate of advance and withdrawal movements of piston 12 and ram 9. It is possible to determine the moment at which the forging pressure is discontinued on workpiece 8. At the same time, valve rod 20 may be withdrawn at a higher or lower speed, whereby the pressure drops more or less quickly. The ram speed in its advance and return movement is between about 200 and 1000 mm per second.

Bore 25 extends inside piston 12 from valve seat member 17 to a location where discharge openings **25*a* are registered with apertures 28 formed in guide bushing or annular partition 27. Two or more apertures 28 direct pressure fluid from piston 12 into an annular discharge chamber 26. With this arrangement conduit 32 connects to bore 25 which communicates in axial direction of ram 9 with apertures 28**.

Conduit 30 extends from a hydraulic driving unit (not shown) to cylinder inlet pressure chamber 14 at the inlet side of piston 12 for the pressure fluid. Chamber 26 is connected to one or more fluid discharge pipe lines 32 which communicate with a hydraulic fluid reservoir (not shown) and constitute an outlet of pressure fluid which is cycled through forging assembly 1. Conduit 31 feeds and directs fluid under constant pressure to annular chamber 15 beneath an undercut shoulder portion of piston 12 as shown. The ratio of the surfaces of the mutually counteracting surfaces of pressure chamber 14 and of annular return pressure chamber 15 is about 5:1.

To advance piston 12, and thus ram 9, valve cone rod 20 moves toward valve seat 21 of valve seat member 17 causing the free flow cross-section between seat member 17 and rod 20 to be reduced thereby restricting a free flow of pressure fluid through valve seat member 17 with a resultant pressure build-up in cylinder chamber 14 causing a forward movement of piston 12 and ram 9 toward workpiece 8. When ram 9 strikes workpiece 8, its further movement is stopped. However, since valve cone rod 20 follows the forward movement of piston 12, valve seat 21 is closed with a resultant pressure build-up in chamber 14. When valve seat member 17 is closed, pressure build-up in chamber 14 is sufficient to cause tool 10 to penetrate into workpiece 8.

Ram 9 with piston 12 travels forwardly until valve cone rod 20 is withdrawn to a preselected backward position upon piston 12 reaching a preselected forward position. The advance movement of ram 9 is dictated by the extent to which valve rod 20 is moved forward by actuator 23, such movement being dependent upon the size of the diameter of workpiece 8. Upon completion of the forging operation, when piston 12 and ram 9 are to be withdrawn, valve rod 20 is withdrawn by actuator 23. Consequently, valve seat member 17 is opened and the pressure fluid may flow through bore 25 and openings 25*a* into conduit 32. In other words, the pressure fluid may be allowed to act on workpiece 8 for an optional time. It is possible to open the valve at any preselected time to initiate the withdrawal movement.

Withdrawal takes place while the pressure fluid may freely flow through bore 25 and openings 28 from chamber 14 to chamber 26 and back into the hydraulic fluid reservoir through conduit 32. Due to an ever existing counterpressure in central piston return pressure chamber 15, piston 12 carrying ram 9 is automatically returned. Valve cone rod 20 is guided out of cylinder 11 through bushing 19*a* of cylinder cover 19. The electro-hydraulic actuator 23 advances and returns valve cone rod 20 at a preselected speed into preselected forward and backward positions. In response to the movement of valve cone rod 20, piston 12 adopts the same motion cycle including the same stroke length and stoke position accordingly.

In operation, valve cone rod 20 moves into a predetermined position as determined by the preset actuator 23. In the predetermined position, valve cone rod 20 abuts valve seat 21 of valve seat member 17 reducing pressure fluid flow therethrough. Thus, pressure develops in inlet pressure chamber 14 to urge piston rod 12 with ram 9 to advance toward workpiece 8. Forging tool 10 fixed to the front end of ram 9 penetrates into workpiece 8. Upon reaching the desired depth of penetration, valve cone rod 20 returns by a preselected stroke length caused by the presetting of hydraulic actuator 23. The pressure medium or fluid then flows from chamber 14 through the open valve seat member 17 and through bores 25 and 28 into discharge chamber 26 and back through discharge conduit 32 into the fluid reservoir container.

Due to the constant pressure in central annular return pressure chamber 15, piston 12 is returned together with ram 9. This operation is repeated with each stroke movement. The servo actuator unit 23 acts as a measuring and control assembly thereby making it possible to compare the actual and the desired performance which may be regulated with each movement by control of servo unit 23. The same actual-desired phase comparisons are realized and regulated simultaneously with all four forging units 2, 3, 4 and 5 for a synchronous operation of all forging tools or two pairs of forging tools.

In supply conduit 30 for the pressure medium, for example, pressurized air, pressures within the range of about 200 to about 600 kp/cm$^2$ are used as needed. The pressure within conduit 31 is at a considerably smaller pressure. Conduit 31 is the medium supply conduit into return pressure chamber 15 of the piston/cylinder unit with pressures in the range of about 30 to about 120 kp/cm$^2$ as needed. Return pressure chamber 15 is always pressurized.

In another embodiment, the return-pressure means comprising central piston return chamber 15 and pressure conduit 31, may act as spring, as a pressure accumulator, or as a hydraulic pressure control unit. Further, actuator 23 may comprise an electric or pneumatic advance control for valve cone rod 20 with corresponding regulation of the initial and final position control.

The important aspect of all designs of the control means, particularly for large diameter working cylinders, is that only minimum control forces are required because control or valve cone rod 20 is located in the flow path of the hydraulic pressure fluid. Thus, the end face of control rod 20 is only exposed to the action of the relieved pressure fluid moving away from chamber 14 via bore 25 to the reservoir. Even with high pressures in chamber 14, control valve cone rod 20 may be moved with very little power requirement, thus enabling it to follow the control signals more quickly and more accurately.

The disclosed performance is particularly suited for realizing operations involving large diameter working cylinders in the range of more than about 400 millimeters of nominal width. The determination of the end position of piston 12 during the working stroke which corresponds to a defined stop of piston movement inert in case of large diameter working cylinders, not being dependent upon a control of the drive-sided pump delivery nor from a control of the counterpressure force supplied from the return pressure unit, the two influencing parameters may be held constant in that the control of the working stroke is only performed by the nearly powerless movement of actuator 23 operating with discharge opening 25 in piston 12.

For coupling the working cylinders of the multi-ram forging machine, care must be taken only with respect to the synchronism of speed and stroke for a synchronous movement of the respective actuators 23 operating nearly pressureless between the fixed initial and end positions because path and speed of the piston stroke in the working cylinder are only dictated by the motion characteristics of the actuating members rather than by the delivery flow of the driving pumps.

While the multi-ram forging assembly with piston-cylinder unit has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. In a multi-ram forging assembly having a piston-cylinder unit for driving each ram carrying a forging tool wherein at least two diametrically opposed forging tools simultaneously act on a workpiece, each piston-cylinder unit comprising:

(a) a pressurized inlet chamber for containing a hydraulic pressure fluid at a predetermined pressure behind piston means movably disposed in a cylinder, said piston means including a front-end ram means for carrying a forging tool, (b) valve means disposed on the piston means at a rear side opposite to the front-end ram means, (c) said valve means including valve seat means and valve cone means having a closed position and an open position, (d) actuator means connected to move the valve cone means between said closed and open positions, (e) the piston means including a passage bore extending from the valve seat means to a pressure fluid discharge means located in the cylinder, (f) pressure fluid inlet means for maintaining the predetermined pressure in the pressure fluid medium within the inlet chamber in advance of the valve seat means, (g) means for connecting said pressure fluid discharge means to a hydraulic pressure fluid reservoir container providing a pressureless discharge of the pressure fluid, and (h) a piston return pressure chamber within the cylinder to cause the return of the piston means under the action of a pressure fluid having a selected predetermined pressure maintained within said piston return pressure chamber.

2. In a forging assembly as defined in claim 1 including means for maintaining a constant predetermined pressure in the central return pressure chamber.

3. In a forging assembly as defined in claim 1 wherein said valve means includes a separate holding plate for receiving the valve seat means.

4. In a forging assembly as defined in claim 1 wherein said valve seat means forms a part of said piston means.

5. In a forging assembly as defined in claim 1 wherein said piston means includes a piston member and a ram formed as an integral one-piece unitary construction.

6. In a forging assembly as defined in claim 1 wherein said cylinder includes guide bushing means disposed around the piston means forming said pressure fluid discharge chamber between an inside wall of the cylinder and the guide bushing means, said guide bushing means including discharge openings for discharging fluid medium from the piston bore into the pressure fluid discharge chamber.

7. In a forging assembly as defined in claim 6 wherein said cylinder includes undercut peripheral shoulder surfaces between which the guide bushing means is disposed and located intermediate the inside cylinder wall and the piston means.

8. In a forging assembly as defined in claim 1 wherein there are two forging tool pairs with respective piston-cylinder units disposed around the workpiece, and control means operate each of the two forging tool pairs simultaneously or alternatingly with respect to the workpiece.

9. In a forging assembly as defined in claim 1 wherein said actuator means includes a servo unit to operate each of the piston means for effecting simultaneous stroke movement, uniform stroke length, and uniform and/or paired stroke position setting of all cylinder units, and control means for electronically programming said servo units.

10. In a forging assembly as defined in claim 1 wherein said valve cone means includes a valve cone at the end of a valve cone rod, said valve seat means includes a valve seat member having a valve seat shaped to receive said valve cone, and said actuator means includes an actuator servo unit coupled to said valve cone rod to effect movement of said valve cone with respect to said valve seat.

11. A forging assembly comprising:

(a) two forging tool pairs with respective piston-cylinder units disposed around the workpiece, (b) each said piston-cylinder unit including a pressurized inlet chamber for containing a hydraulic pressure fluid at a predetermined pressure behind piston means movably disposed in a cylinder, each said piston means including a front-end ram means carrying a forging tool, (c) valve means disposed on each piston means at a rear side opposite to the front-end ram means, (d) each said valve means including valve seat means and valve cone means having a closed position and an open position, (e) actuator means connected to move each valve cone means between said closed and open positions, (f) each said piston means including a passage bore extending from the valve seat means to a pressure fluid discharge means located in each respective cylinder, (g) pressure fluid inlet means for maintaining the predetermined pressure in the pressure fluid medium within each inlet chamber in advance of each valve seat means, (h) means for connecting each said pressure fluid discharge means to a hydraulic pressure fluid reservoir container providing a pressureless discharge of the pressure fluid, (i) a piston return pressure chamber within each respective cylinder to cause the return of each piston means under the action of a pressure fluid having a selected predetermined pressure maintained within each respective piston return pressure chamber, and (j) control means operate such of the two forging tool pairs simultaneously or alternatingly with respect to the workpiece.

* * * * *